United States Patent [19]

Winston

[11] Patent Number: 4,997,183

[45] Date of Patent: Mar. 5, 1991

[54] ANKLE WEIGHT EXERCISE DEVICE

[76] Inventor: Edith Winston, 135 Hazelwood Dr., Jericho, N.Y. 11753

[21] Appl. No.: 134,685

[22] Filed: Dec. 18, 1987

Related U.S. Application Data

[63] Continuation-in-part of Ser. No. 506,059, Jun. 20, 1983, abandoned.

[51] Int. Cl.[5] ..... A63B 21/065

[52] U.S. Cl. ..... 272/119

[58] Field of Search ..... 272/119, 93

[56] References Cited

U.S. PATENT DOCUMENTS 2,241,833 5/1941 Waller ..... 272/119
3,366,380 1/1968 Montour ..... 272/119
3,528,652 9/1970 Tarbox ..... 272/119
3,924,851 12/1975 Winston ..... 272/119

*Primary Examiner*—Robert Bahr

[57] ABSTRACT

A fabric body of a rectangular shape for encircling a user's ankle. The fabric is constructed with a plurality of side-by-side compartments, each having an opening thereinto to receive a weight, and including a pair of flaps attached in lengthwise extending relation from the opposite ends of the device and wherein each flap has an upwardly inclined edge which in the ankle-encircling position cooperates with the other flap upwardly inclined edge to thereby form an inverted V-shape which contributes to holding the device in position during the exercising use thereof.

1 Claim, 3 Drawing Sheets

ANKLE WEIGHT EXERCISE DEVICE

The present invention is a continuation-in-part of application Ser. No. 506,059 filed Jun. 20, 1983 for Ankle Exercise Device, now abandoned.

The present invention relates generally to an improved exercise ankle band, and more particularly to a band construction which assists in confining the weights in the band and which also makes the band more comfortable to wear as well as providing more mobility during the use thereof.

Weighted bands or the like are worn around the ankles, waist and other locations to make the exercise routine more strenous, and thus more beneficial for muscle tone and other such objectives. For obviousd reasons, it is advantageous to be able to embody any selected number of weights in the band, the thereby adjust the exercising weight. With a weighted band worn about the ankle, extensive leg movements could inadvertently dislodge a weight therefrom, since such weight is free of connection to the band so that it can be readily inserted and removed from the band preparatory to adjustment of said exercising weight.

EXAMPLES OF THE PRIOR ART

The prior art provides laced ankle weights which, in use, compress the weights thereof against tarsal bones and muscles that move the ankle joint.

U.S. Pat. No. 2,241,833 issued on Mar. 6, 1940 to Waller is an example of a laced exercise device, which would so severly limit ankle movement that its preferred position in use, as best shown in FIG. 3, worn about the calf.

U.S. Pat. No. 3,366,380 issued on Jan. 30, 1968 to Montour is a laced weighted ankle band that is worn below the calf and about the ankle, but lacks in its design appropriate means for removing pressure and constriction from the body of the ankle joint so as to enable weight training without pressure, and without constriction and tension limiting movement. Thus, in Montour, each pocket (24, 26, 28, 30) is filled with weight particles surrounding the ankle joint, and forming in effect a solid unit, wherein in use by gravity the particles all press downward, placing pressure and friction against all range of motion of the ankle joint, such as inversion, eversion, plantar and dorsi flexion.

Broadly, it is an object of the present invention to provide an improved exercise ankle band overcoming the problem of inadvertent dislodgement of the weights and other shortcomings of the prior art. Specifically, it is an object to both confine said weights, and also to prevent constriction of areas requiring mobility and to render the band more confortable to use, by simple, inexpensive components, all as is hereinafter described.

In addition to obviating the need for lacing and, more important, the need to rely on the tightening of laces to hold the band in position during use, the ankle exercise band hereof has, among other noteworthy features, a front V-shaped opening (48) and rear inverted arcuate opening (150, 250) which significantly contribute both to the proper positioning and comfort in wearing the band. A pair of front flaps which form the front V-shape opening are each fully cushioned from top to base, and the V-shaped opening there between is strategically located to provide an open, non-constricting, comfortable, tension free, friction free, pressure free area permitting prime mover musculature of the ankle joint throughout its full range of motion.

The referred to rear inverted arcuate opening is designed to fit comfortably and snugly over any standard sneaker or exercise shoe, thus lessening to a significant extent any reliance on the need to firmly encircle the band around the ankle to achieve the proper positioning thereof.

The exercise ankle bands hereof are designed not only for maximum comfort, but also to minimize trauma to the ankle of the user. It is known, for example, that Achilles tendinitis or disabling heel cord pain is a most common sports problem brought about mostly by the sudden stress or strain from foot strikes to takeoff during sports activity. During training, many athletes include ankle weights in their walking and running programs. Available prior art ankle weights aggravat the Achilles tendon area of the user and in most cases limit ankle flelxibility.

The above brief description, as well as further objects, features and advantages of the present intention, will be more fully appreciated by reference to the following detailed description of presently preferred, but nonetheless illustrative embodiments in accordance with the present invention, when taken in conjunction with the accompanying drawings, wherein.

Figure 5:
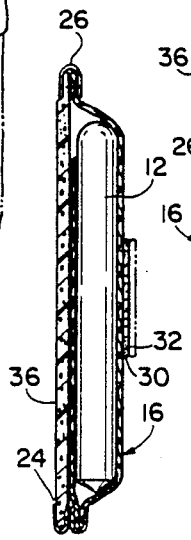
Figure 4:
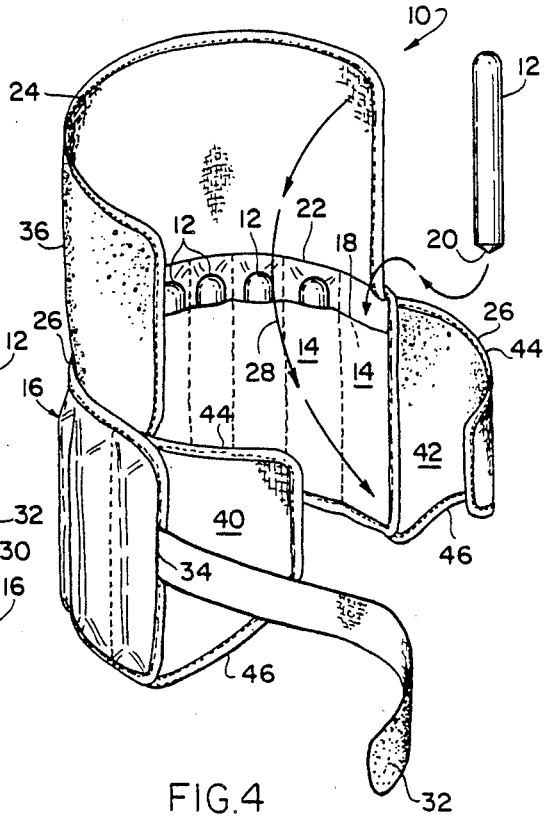
Figure 2:
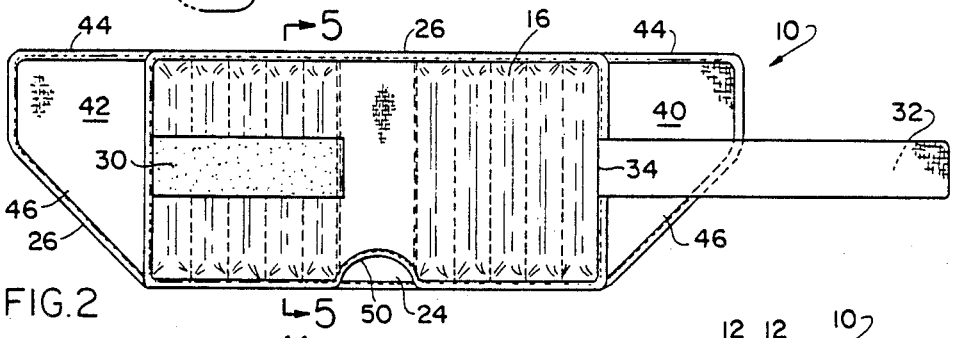
FIG. 2 is a side elevational view of the device illustrating the external surface thereof.
Figure 3:
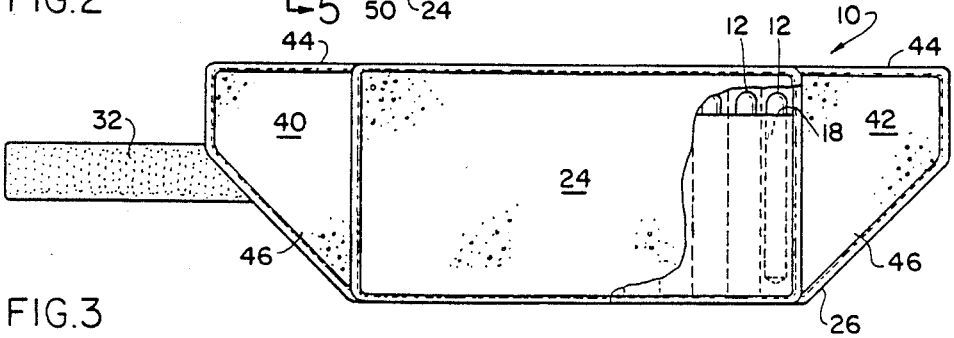

FIG. 3. is similarly a side elevational view, but illustrating the internal surface, or surface adjacent the user's ankle;

FIG. 4. is a perspective view illustrating how the individual weights are readily inserted; and FIG. 5. is an end elevational view, as taken along line 5—5 of FIG. 2, showing further structural details.

Additional embodiments are shown in the remaining figures, wherein

Figure 6:
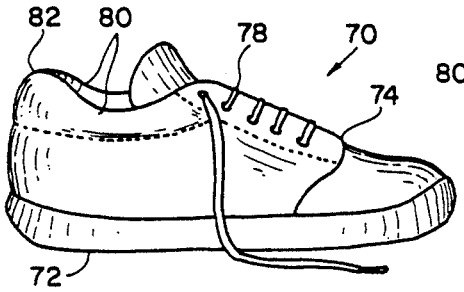
Figure 7:
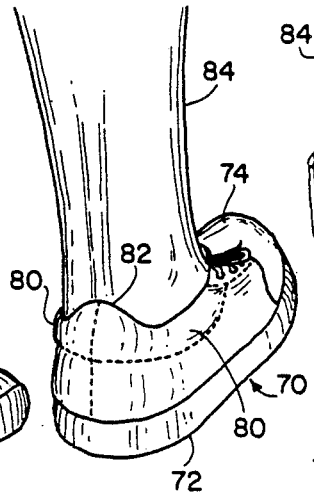
Figure 8:
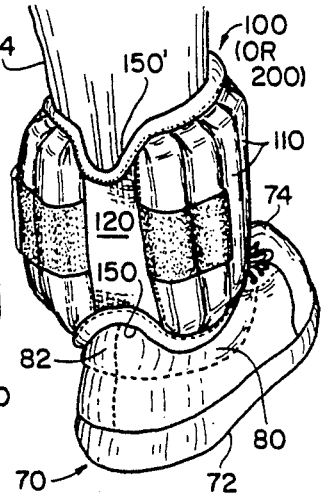
Figure 9:
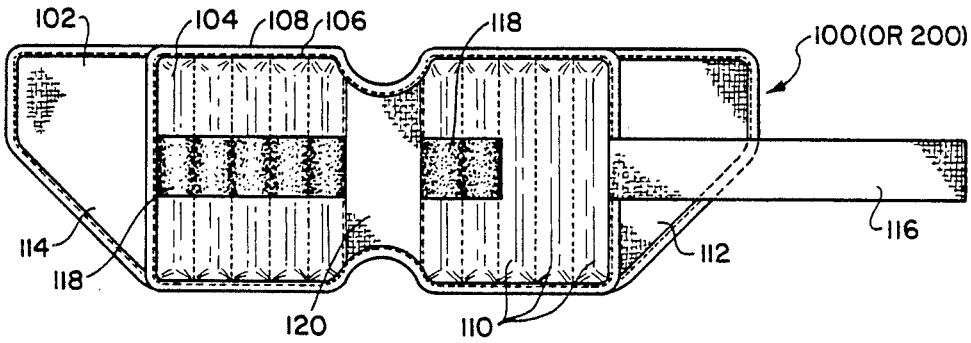
Figure 10:
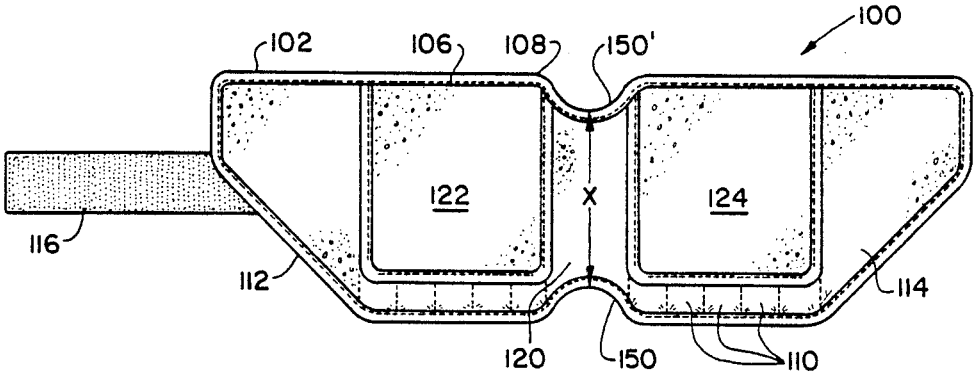
Figure 11:
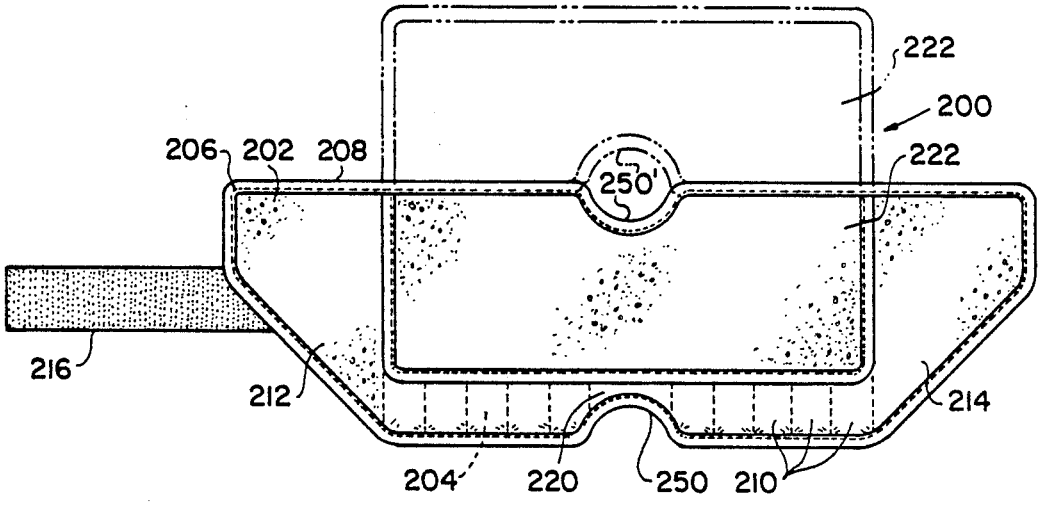

FIG. 6. is a side elevation of one type of low cut sport or recreation shoe;

FIG. 7 is a rear perspective view of the shoe shown in FIG. 6, with the user's foot in place;

FIG. 8 is a view similar to FIG. 7, in which the ankle exercise weight hereof is shown on the user's ankle;

FIG. 9. is a view of the outer side, similar to FIG. 2, of the ankle weight for the two embodiments shown in FIGS. 10 and 11;

FIG. 10 is a view of the inner side, similar to FIG. 3, of the ankle weight constituting a second embodiment;

FIG. 11 is a view of the inner side, similar to FIG. 3, of the ankle weight constituting a third embodiment; and FIGS. 12A–D are schematic views of ankle articulation as it relates to the invention.

Before providing a description of the inventive ankle exercise bands, it is believed helpful to first describe the instructional FIGS. 12 A–D which show positions of a typical foot during walking or running. In these figures point P represents the pivot between the lower leg and foot; the point at which the tibia and fibula of the leg articulate with the astragalus of the foot. Line L represents the effective axis of the leg and line F the effective axis of the foot. Angle A is the angle between lines L and F. Line R is a reference line and C represents the profile curvature of the leg in the Achilles tendon area. G signifies the ground surface.

Figure 12C:
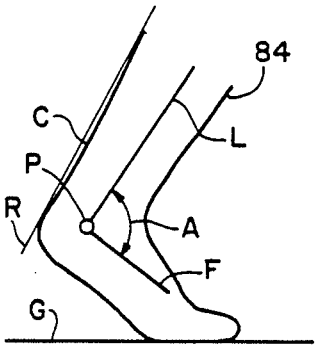
Figure 12B:
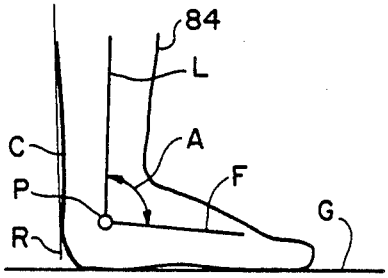
Figure 12A:
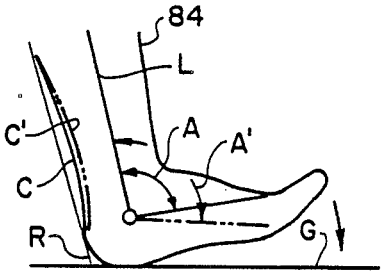

FIG. 12A shows the foot as it touches the ground, heel first. Angle A is at this time approximately 90° or slightly less. Since the Achilles tendon is relaxed, curve C is concave. As the foot follows through and rotates to the ground G, angle A' becomes greater and curve C' becomes more concave (broken lines).

FIG. 12B shows the foot at midstride, when angle A is approximately 90°. Since the leg is propelling the body forward, the Achilles tendon is taut and curve C is almost a straight line.

FIG. 12C shows the foot at the point of takeoff in a stride. Depending on the forward thrust of the body, angle A may be considerably less than 90°, as in the case of a sprinter at the beginning of a race. In this circumstance the Achilles tendon is under maximum tension and in its most straight position. This condition is known as Dorsiflexion.

Figure 12D:
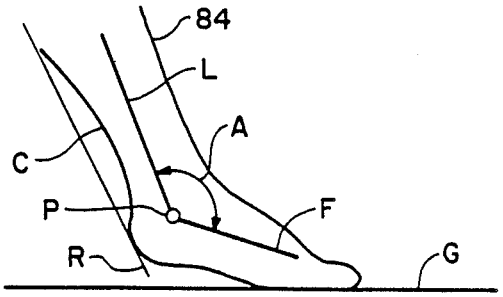

The extreme opposite, Plantar flexion, is shown in FIG. 12D, where the athlete prefers to land his foot toe first, and the angle A and curve C are at maximum. During hard training, with ankle weights, the athlete may cycle each foot from the condition in FIG. 12C Dorsiflexed to that of FIG. 12D Plantar flexed with each stride. Angle A could have a range of as much as 50°. Curve C varies from straight line to maximum curvature repeatedly and rapidly as tension in the Achilles tendon changes from maximum to minimum during each cycle. It is evident that any encumbrance, in the vacinity of the Achilles tendon, will encourage trauma of its own, and discourage healing of existing adverse conditions.

EMBODIMENT OF FIGS. 1-5

Figure 1:
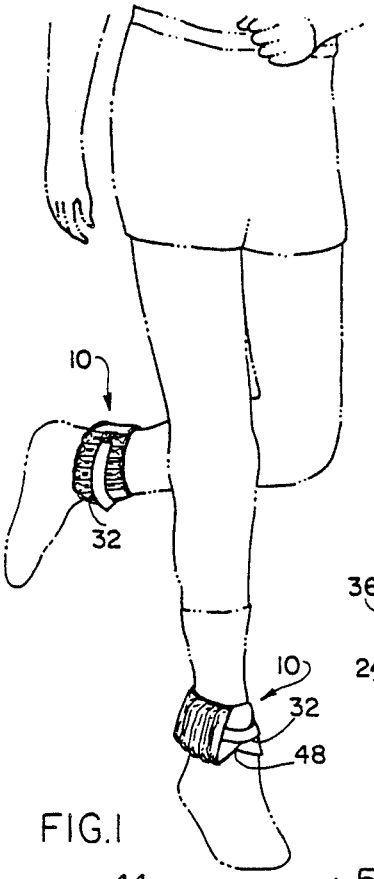
FIG. 1 is a perspective view illustrating a first embodiment of the exercise device in its ankle-encircling position.

Reference is now made to FIGS. 1-5 of the drawings wherein there is shown an ankle exercise device, generally designated 10, which as illustrated in FIG. 1 is adapted to be worn about the user's ankle. Beneficial use of the device 10, as an exercising aid, is derived by inserting a selected number of cylindrically shaped weights, individually and collectively designated 12, in individual cooperating compartments 14 appropriately formed in the fabric body 16 of the device 10. Any appropriate sewing technique can be used to form the compartments 14. For example, they may be formed in the same way that finger-receiving compartments are formed in gloves. In any event, the significance of the compartments 14 and the cooperating weights 12 is that any number of such weights 12 can be embodied in the device 10 by inserting each in its cooperating compartment 14, thereby providing the user of the device 10 with a choice of how heavy an exercise device 10 he wishes to use during an exercise routine.

Since the weights 12 are unattached to the device 10, to facilitate their easy insertment and removal, it is necessary, and accordingly therefore contemplated by the present invention, to obviate any likelihood of a weight 12 previously inserted in a cooperating compartment 14 to inadvertently come out of said compartment during exercising movement. To this end, each compartment 14 has an appropriate opening 18 thereinto, through which the conical end 20 of each weight 12 is inserted in order to place the weight 12 within the compartment 14. In accordance with the present invention, the aforesaid openings 18 are strategically located adjacent edge 22 of the fabric body 16. Along the same edge 22, device 10 is then provided with a flap 24, the edge of flap 24 and the edge 22 being connected by an appropriate edge finishing piping 26 or the like. The unattached portion of flap 24 is of course foldable, in the direction 28, against the fabric body 16. From what has been described, it should be readily appreciated that in its folded position, flap 24 functions as a closure or cover over the compartment openings 18 and, in this manner, assists in confining the weights 12 within the compartments 14.

In the illustrated embodiment of the device 10, the same is maintained in its ankle-encircling position, as illustrated in FIG. 1, by cooperating velcro strips 30 and 32. Specifically, component 30, as illustrated in FIG. 2, consists of patches of velcro appropriately secured adjacent one end of the fabric body 16. As illsutrated in FIGS. 2, 4, component 32 body 16 so that the velcro thereon is in an exposed position to engage with the velcro patches 30 when the device 10 is wrapped around the user's ankle. Engagement of the velcro patches 30 with the strips 32 is illustrated in FIG. 5. Also illustrated in cross-section in FIG. 5 is flap 24. This cross-sectional perspective of flap 24 is intended to demonstrate that the same advantageously includes as an internal component a panel of plastic foam 36 which, because of its resilient nature and its position in contact dwith the wearer's ankle, contributes, in an obvious manner, to the comfort of the user during the wearing of the device 10.

Specifically provided to effectively maintain a "proper" position of each band 10 on the user's ankle are end flaps or extensions 40 and 42. By a proper position is meant one that is above the location at which the ankle portion of the leg is connected to the foot, and above the normal position of a sneaker, and thus where there is articulating movement during use of the exercise band or device 10 during walking and jogging. Each flap 40, 42 has an upper horizontally oriented edge and coextensive portion 44 which is an extension of the medial body portion 16 of each band. Completing each flap 40, 42 is an upwardly inclined edge and coextensive portion 46 which, in the ankle-encircling position of FIG. 1, forms an inverted V-shape 48 which fits over a sneaker or athletic shoe, and thus holds the band in proper position on the user's ankle and/or foot portion which protrudes forwardly through the inverted V-shape 48.

As may best be noted in FIG. 2, there is a space 27 left in the middle of the device 10 and between the rows of weights 12, which coincides with the location of the user's Achilles tendon. Space 26 is foam padded, and because it is free of any weights, does not press against, and thus cause any physical damage or disconfort to the Achilles tendon.

Similarly, it is to be noted that there are no weights 12 in the area of the flaps 40 and 42. Thus, there are no weights which might constrict mobility or other wise interfere with flexing of the user's ankle.

EMBODIMENTS OF FIGS. 10 and 11

In FIGS. 6, 7 and 8 a popular type, low cut sport or recreation shoe is illustrated. Shoe 70 has a sole 72, a stitched upper 74 of fabric or leather, lacing 78 or other closure means and a padded cuff 80 which includes a raised padded tab 82 at the rearmost position. Cuff 80 and tab 82 are designed for maximum comfort and to minimize trauma to the ankle of the user 84.

Ankle weight 100 (FIG. 10) and 200 (FIG. 11) both have the same outward appearance as seen in FIG. 9.

A laminated cloth and foam panel 102 is sewn to cloth panel 104 at stitching 106 and piping 108, and in such a way as to form weight pockets 110. Weights 12 can thus be inserted as required by the user as described in the first embodiment 10.

Ankle panels 112 and 114 are shaped to wrap comfortably about the front of the ankle. Strap 116 with velcro loops adjustably engages velcro hook patches 118.

When pockets 110 are stitched, a center panel 120 is left midway on body panel 102. This is logically done so no weights 12 will be directly over the Achilles tendon of the user.

On the inner face of ankle weight 110 (FIG. 10) a shortened and divided pair of flaps 122 and 124 are used to cover the weight loading openings 118 (not shown). Flaps 112 and 124 are made of the same cloth/foam material as panel 102, edged with piping 108 and stitched into the main body panel 102 by stitching 106 along their upper edge only. At the lower and upper ends of panel 120 are arcuate cutouts 105 and 150' appropriately trimmed with piping 108. The lower cutout 150 is proportioned to mate with elevated tab 82 as shown in FIG. 8. Nesting of tab 82 in cutout 150 keeps the ankle weight 100 from rotating about the ankle. Ankle weight 100 would also have a tendency to slide downwardly, but is now supported on elevated tab 82.

Upper cutout 150' is intended to cooperate with lower cutout 150 so that the contact length of panel 120 with the Achilles tendon is reduced. These cutouts 150 and 150' along with the space left between flaps 122 and 124 greatly reduce the restrictive action of the ankle weight when the foot is in the plantar flexion mode as especially shown in FIG. 12D, by effectively shortening the chord length X (FIG. 10) of the ankle weight in contact with the curve C, thereby allowing for greater ankle flexibility.

The inner face of a third embodiment 200 is shown in FIG. 11.

Ankle weight 200 has a laminated cloth/foam panel 202 which is sewn to cloth panel 204 at stitching 206 and piping 208 and in such a way as to form weight pockets 210.

Ankle weight 200 has formed ankle panels 212 and 214 along with velcro strap 216 and patches 218 (not shown). Center panel 220 is left without weight pockets.

On the inner face of ankle weight 200 (FIG. 11) a flap 222 is provided like flap 24 (FIG. 4), but it is shorter and is sewn within piping 208 along its upper edge. Flap 222 covers weight loading openings 218 (not shown). Cutout 250 is made and functions like cutout 150 of ankle weight 100. However, cutout 250' in flap 222 has to be piped and sewn separately to allow for 180° unfolding (broken line) (FIG. 11) in order to load and unload weights 12.

Ankle weight 200 functions as does ankle weight 100. The added padding of flap 222 may be favored by some exercisers as each has his/her own muscular and skeletal peculiarities, perhaps preferring one of the embodiments over the others.

A latitude of modification, change and substitution is intended in the foregoing disclosure, and in some instances some features of the invention will be employed without a corresponding use of other features. Accordingly, it is appropriate that the appended claims be construed boardly and in a manner consistent with the spirit and scope of the invention herein.

What is claimed is:

1. An exercise device for use with a recreational shoe of the type having a rear upwardly extending tab and adapted to be worn around the user's ankle comprising a medial fabric body of a rectangular shape having upper and lower edges and a lengthwise extent so as to be worn in an ankle-encircling position about the user's ankle, an arrangement of plural side-by-side compartments each having an opening thereinto located adjacent an edge of said fabric body, a selected number of said compartments being used for cooperating weights placed therein preparatory to exercising service of said device, a weights-covering flap having a resilient plastic foam body secured along said fabric body edge adjacent said compartment openings having an operative position folded over said openings against said fabric body and occupying an interposed position between said exercise device and said user's ankle, a pair of flaps attached in lengthwise extending relation from opposite ends of said medial rectangular shape, each said flap having an upwardly inclined edge which in said ankle-encircling position cooperates with said other flap upwardly inclined edge to form an inverted V-shape to receive therein the ankle of said user, whereby said V-shape contributes to holding said device in position during the exercising use thereof, and in vertical alignment in the rear of said medial fabric body an inverted V-shaped notch in the lower edge thereof and a V-shaped notch in the upper edge thereof, said lower edge notch being adapted to fit over said tab of said recreational shoe to thereby contribute to holding said exercise device in place during the use thereof, and said upper edge notch being in horizontal alignment with the user's Achille's tendon to thereby minimize any restriction by said exercise device on the flexing movements of the user's ankle.

* * * * *